United States Patent [19]

Ito

[11] 4,357,714

[45] Nov. 9, 1982

[54] FABRIC ARTICLES AND THE MANUFACTURE THEREOF

[76] Inventor: Mitsuru Ito, 322 E. 55th St., Apt. 3B, New York, N.Y. 10022

[21] Appl. No.: 145,647

[22] Filed: May 2, 1980

[51] Int. Cl.[3] ..... A41D 1/02; A41D 27/02

[52] U.S. Cl. ..... 2/97; 2/211; 2/227; 2/272; 28/157; 112/440

[58] Field of Search ..... 2/97, 69, 227, 211, 2/222; 112/415, 440, 402; 28/157; 128/500, 499, 539, 555

[56] References Cited

U.S. PATENT DOCUMENTS 1,355,177 10/1920 Sollen ..... 2/97 UX
2,184,772 12/1939 Vamos ..... 2/97 X
2,281,510 4/1942 Newmark ..... 2/97
2,402,032 6/1946 Fischer ..... 2/97

FOREIGN PATENT DOCUMENTS 424660 8/1947 Italy ..... 2/97

*Primary Examiner*—H. Hampton Hunter
*Attorney, Agent, or Firm*—Ladas & Parry

[57] ABSTRACT

A fabric article comprises a piece of stretch fabric and a piece of woven non-stretch fabric in superposed relationship, the two pieces of fabric being secured together in stretch-resisting manner, e.g. by stitching, along first and second lines which extend transversely to each other and obliquely to both the warp and weft directions of the woven fabric.

16 Claims, 11 Drawing Figures

FIG. 4(a)
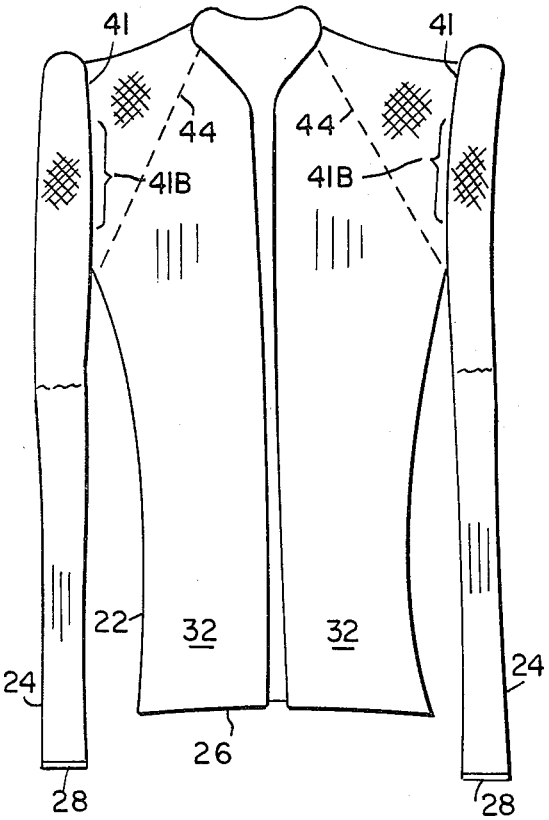
FIG. 4(b)
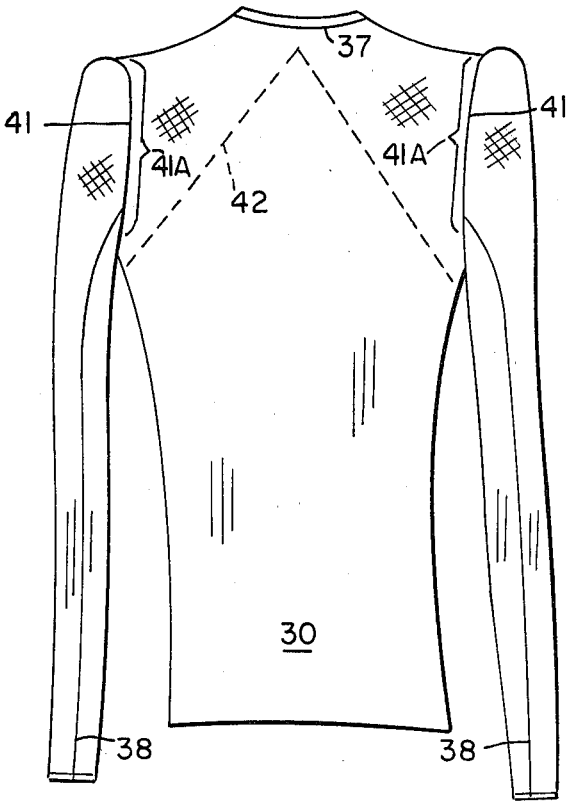
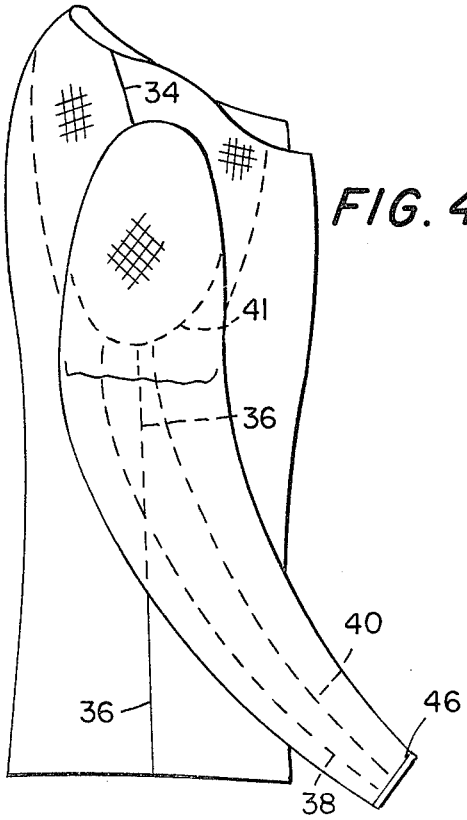
FIG. 4(c)
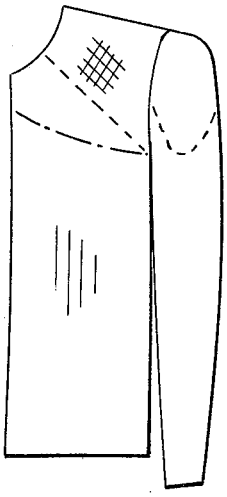
FIG. 4(d)

FABRIC ARTICLES AND THE MANUFACTURE THEREOF

This invention relates to fabric articles and to the manufacture thereof.

Stretch fabric is well known, and is commonly used in manufacture of loose-fitting, non-tailored garments such as baseball jackets. Hitherto, use of stretch fabric in tailored garments has been restricted, because of the very nature of stretch fabric: through stretching of the fabric, the garment tends to lose its shape, defeating the purpose of the tailored fit.

Knit fabric, as opposed to woven fabric, is one form of stretch fabric. Certain types of knit fabric have visual and textural appeal and it is desirable to be able to use such fabrics in tailored garments. Therefore, attempts have been made to minimize the stretching of knit fabric so that when the fabric is used to make a tailored garment the stretching of the fabric is inhibited and the garment thus retains its shape. One known way of improving the shape-retaining characteristics of garments is to line the garments with non-stretch woven fabric. However, when woven fabric is sewn to knit fabric, the woven fabric tends to pucker along the line of sewing, and this gives the knit fabric an unsightly appearance along the line of sewing.

As used throughout this specification, the terms "stretch fabric" and "non stretch fabric" are intended to be relative terms, specifically, a "stretch fabric" is one in which plies of the fabric have an ability to be stretched beyond the fabric original dimensions.

A "non-stretch fabric" is a woven which the fabric has a very limited ability to be stretched beyond its original dimensions in both the warp and the weft directions.

According to one aspect of the present invention there is provided a method of manufacturing a fabric article comprising providing a piece of stretch fabric and a piece of woven non-stretch fabric in superposed relationship, and securing the two pieces of fabric together in stretch-resisting manner along first and second lines which are transverse to each other and oblique to both the warp and weft directions of the woven fabric.

According to another aspect of the present invention there is provided a fabric article comprising a piece of stretch fabric and a piece of woven non-stretch fabric in superposed relationship, the two pieces of fabric being secured together in stretch-resisting manner along first and second lines which extend transversely to each other and oblique to both the warp and weft directions of the woven fabric.

Preferably, the two pieces of fabric are sewn together using inelastic yarn and a stitch without inherent elasticity.

For a better understanding of the invention, and to show how the same may be carried into effect, reference will now be made, by way of example, to the accompanying drawings in which.

Figure 3A:
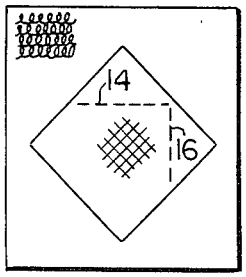
Figure 3B:
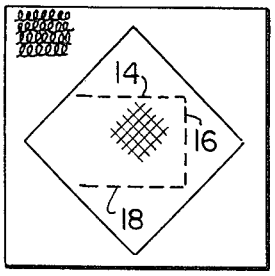
Figure 3C:
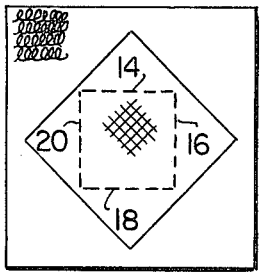
Figure 5:
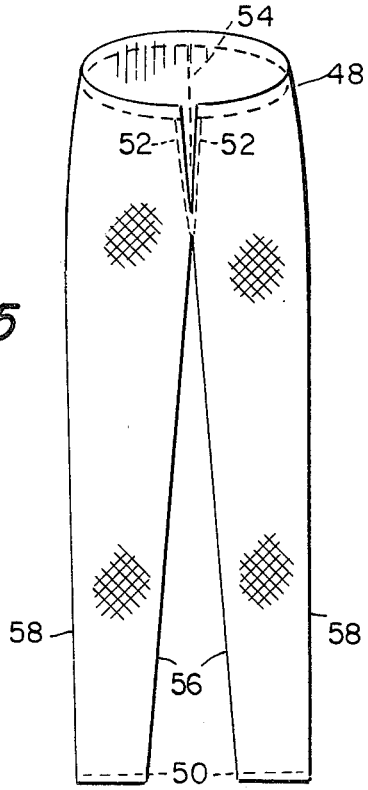

FIGS. 3*a*–3*c* illustrate three ways of securing woven fabric to knit fabric;

FIGS. 4*a*–4*d* illustrate a jacket;

FIG. 5 illustrates pants; and

Figure 6:
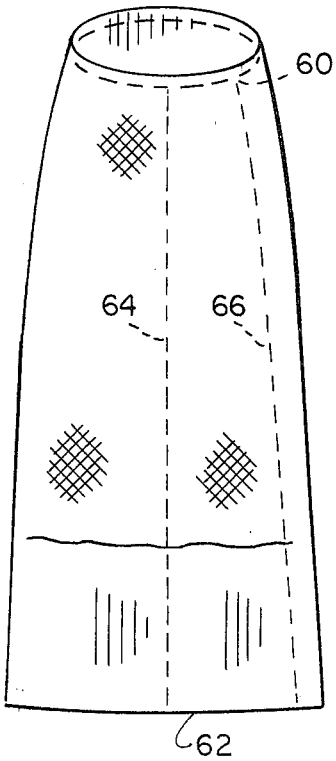

FIG. 6 illustrates a skirt.

Figure 1:
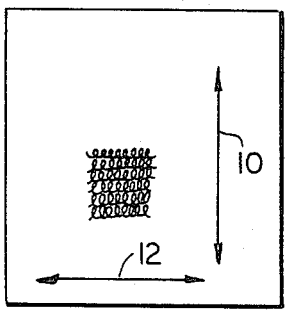
FIG. 1 illustrates in plan a piece of knit fabric.
Figure 2:
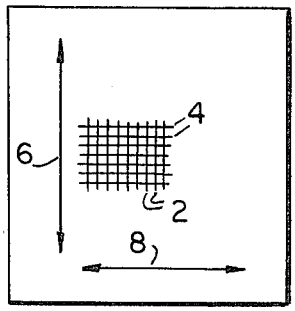
FIG. 2 illustrates in plan a piece of woven fabric.

FIGS. 1 and 2 illustrate diagrammatically respective pieces of straight weave knit fabric and non-stretch woven fabric. A non-stretch woven fabric is made of a warp yarns 2 among which a weft yarn 4 is interwoven, both warp and weft yarns being substantially inelastic. Consequently, the fabric is substantially non-stretchable in both the warp direction 6 and the weft direction 8. However, even so-called non-stretch fabric is in fact normally stretchable in directions diagonal to the warp and weft directions. Knit fabric is formed by interlacing one or more yarns in a series of connected loops by means of hand or machine needles. The fabric is built up in rows extending perpendicular to the direction in which the knitting progresses. The direction 10 in which the knitting progresses can be regarded as analogous to the warp direction 6 of woven fabric, while the direction 12 of the rows corresponds to the weft direction 8. A conventional knit fabric is stretchable in the weft and warp directions and in directions diagonal thereto. The knit fabric illustrated in FIG. 1 is a machine knit fabric.

If the two pieces of fabric are placed in superposed relationship with the warp direction 6 of the woven fabric extending parallel to the warp or weft direction 10 or 12 of the knit fabric and the two pieces of fabric are then sewn together, the woven fabric will pucker, with the result that the finish of the article appears unattractive. On the other hand, when the woven fabric is on the bias with respect to the knit fabric (the warp and weft directions 6 and 8 of the woven fabric extended diagonally to the warp and weft directions 10 and 12 of the knit fabric) and the two pieces of fabric are sewn together by machine, neither fabric puckers and accordingly the finish of the article is not rendered unattractive by the presence of the stitching. If, furthermore, the two pieces are sewn together by means of inelastic yarn using a simple seam stitch without inherent elasticity, the line of sewing prevents stretching of the article in the direction of the line of sewing. Thus, if the two pieces of fabric are sewn together along two lines which extend transversely of each other and obliquely with respect to both the warp and weft directions of the woven fabric, the stretching of the woven fabric in the direction diagonal to the warp and weft directions thereof will be substantially reduced, if not altogether eliminated.

FIG. 3 illustrates three possible ways in which the knit fabric and the woven fabric may be sewn together so as to take advantage of this discovery. In FIG. 3(*a*) the warp and weft directions of the woven fabric extend at 45° to the warp and weft directions of the knit fabric, and the two pieces of fabric are sewn together along two lines 14 and 16 extending at right angles to each other and at 45° to the warp and weft directions of the woven fabric. In FIG. 3(*b*), the woven and knit fabrics are sewn together along three lines 14, 16 and 18 forming three sides of a rectangle and extending at 45° to the warp and weft directions of the woven fabric. In FIG. 3(*c*) the woven and knit fabrics are sewn together along four lines 14, 16, 18 and 20 forming the four sides of a rectangle, which sides extend at 45° to the warp and weft directions of the woven fabric.

It will therefore be appreciated that the combination of the woven fabric, disposed on the bias with respect to the knit fabric, and the lines of seam stitch extending transversely to each other and obliquely to both the warp and weft directions of the woven fabric, resist stretching of the knit fabric in all directions. By virtue of the woven fabric being secured to the knit fabric, the woven fabric resists stretching of the knit fabric in the warp and weft directions of the woven fabric, and the lines of stitching extending obliquely with respect to both the warp and weft directions of the woven fabric resist stretching of the knit fabric in directions which are diagonal to the warp and weft directions of the woven fabric.

Because the lining of woven fabric and the manner in which it is secured to the knit fabric resist stretching of the knit fabric in all directions, use of the three principles described with reference to FIG. 3 makes it possible to make garments of knit fabric which will retain their shape well, and this makes knit fabric acceptable for use in manufacture of tailored garments.

FIGS. 4, 5 and 6 illustrate how the principles described with reference to FIG. 3 can be applied to the production of various garments.

FIG. 4 illustrates a jacket comprising a body portion 22 and sleeves 24. The body portoion and the sleeves are made of knit fabric and are provided with a lining of non-stretch woven fabric. The warp and weft directions of the body portion 22 extend substantially perpendicular and parallel to the bottom edge 26 of the body portion. Similarly, the warp and weft directions of the sleeves 24 extend substantially perpendicular and parallel to the cuffs 28. The body portion of the jacket comprises a back panel 30 and two front panels 32 which are seamed to the back panel along shoulder seams 34 and side seams 36. The body portion also has a collar seam 37. Each sleeve comprises two panels which are seamed together along underarm seams 38 and 40. The sleeves are seamed to the body portion along armhole seams 41.

The body portion 22 has a partial lining comprising a back panel 42 and two front panels 44. The warp and weft directions of the panels 42 and 44 extend at substantially 45° to the warp and weft directions of the corresponding body portion panels 30 and 32. The lining panel 42 is secured to the back panel 30 by virtue of its being seamed thereto along the armhole seams 41, the shoulder seams 34 and the collar seam 37. Similarly, the front lining panels 44 are secured to the corresponding front panels 32 of the body portion by virtue of their being seamed thereto along the armhole seams 41 and the shoulder seams 34. The shoulder seams 34 extend obliquely to both the warp and weft directions of both the back panel 42 and the front panels 44. Similarly, the armhole seams 41 extend over the positions 41A obliquely both to the warp and weft directions of the back panel 42, and over the portions 41B extends obliquely both to the warp and weft directions of the front panels 44. The portions 41A and 41B of the armhole seam 41 extend transversely of the shoulder seams 34. Thus, the front of the jacket makes use of the principle described with reference to FIG. 3(*a*), while the back makes use of the principle described with reference to FIG. 3(*b*).

Each sleeve has a full lining in the form of two panels which underlie the two panels of the sleeve respectively. The lining panels are sewn to the overlying panels of knit fabric the seams 38, 40 and 41 and along cuff seams 46. The panels of woven fabric are disposed with their warp and weft directions extending obliquely to the various seams, and thus the sleeve panels use the principle described with reference to FIG. 3(*c*). Alternatively, the sleeve linings may be partial, ending in an unattached edge above the cuff, in which case they would employ the principle described with reference to FIG. 3(*b*).

The front panels 44 of woven fabric are illustrated in FIG. 4(*a*) as being substantially triangular, with one corner being at the point where the shoulder seams meets the neck opening. The front panels may alternatively be as shown in FIG. 4(*d*), in which they have an edge which is secured to the front panels 32 of knit fabric along at least a part of the neck opening, or even along the edge of the front opening of the jacket, as shown in dot-dashed lines. In this way, the front panels of woven fabric make use of the principle described with reference to FIG. 3(*b*).

FIG. 5 illustrates, inside out, pants made of knit fabric and having the warp and weft directions extending perpendicular and parallel respectively to the waistband 48. The pants have a full lining of woven fabric having the warp and weft directions extending at substantially 45° to the waistband 48. The pants have the usual front and back panels for each side, and the lining similarly has front and back panels for each side. The lining panels are secured to the overlying panels of knit fabric along the cuffs 50, waistband 48, front and back seams 52 and 54 and the inside and outside leg seams 56 and 58. Thus, the pants make use of the principle described with reference to FIG. 3(*c*). Alternatively, the lining may be partial, terminating in an unattached edge above the cuff, in which case the pants would make use of the principle described with reference to FIG. 3(*b*).

FIG. 6 illustrates, inside out, a skirt. The skirt is made of several panels of knit fabric having its warp and weft directions extending substantially perpendicular and parallel respectively to the waistband 60 and lower hem 62 of the skirt. The skirt has a partial lining of woven fabric made up of panels corresponding to the panels of the knit fabric, the panels of the lining being secured to the panels of knit fabric by virtue of their being seamed to the knit fabric where the panels of knit fabric are seamed together, as shown at 64 and 66. The panels of woven fabric are also secured to the knit fabric where the knit fabric is folded over and seamed to form the waistband 60. Thus, the skirt of FIG. 6 makes use of the principle described with reference to FIG. 3(*b*). The skirt may alternatively have a full lining, in which case the panels of woven fabric would be secured to the panels of knit fabric at the lower hem of the skirt, and in this case the skirt would use the principle described with reference to FIG. 3(*c*).

It is to be understood that the invention is not limited to the specific methods and articles which have been described, since it will be apparent to those skilled in the art that variations may be made without departing from the scope of the invention as defined in the appended claims.

I claim:

1. A method of manufacturing a fabric article comprising providing a piece of stretch fabric and a piece of woven non-stretch fabric in superposed relationship, and securing the two pieces of fabric together in stretch-resisting manner along first and second lines which are transverse to each other and oblique to both the warp and weft directions of the woven fabric.

2. A method as claimed in claim 1, wherein the warp and weft directions of the woven fabric are substantially perpendicular to each other, and said first and second lines are substantially perpendicular to each other and are disposed each at substantially 45° to the warp and weft directions of the woven fabric.

3. A method as claimed in claim 1, wherein the pieces of fabric are secured together in stretch-resisting manner along a third line extending substantially perpendicular to said first line and disposed to the same side of said first line as said second line.

4. A method as claimed in claim 3, wherein the first line is substantially perpendicular to the second line and the pieces of fabric are secured together in stretch-resisting manner along a fourth line extending substantially perpendicular to said third line and joining said third line to said second line.

5. A method as claimed in claim 1, 2, 3 or 4, wherein the pieces of fabric are secured together in stretch-resisting manner along each of said lines by sewing along each line.

6. A fabric article comprising a piece of stretch fabric and a piece of woven non-stretch fabric in superposed relationship, the two pieces of fabric being secured together in stretch-resisting manner along first and second lines which extend transversely to each other and oblique to both the warp and weft directions of the woven fabric.

7. An article as claimed in claim 6, wherein the warp and weft directions of the woven fabric extend substantially perpendicular to each other, and said first and second lines extend substantially perpendicular to each other and each at substantially 45° to both the warp and weft directions of the woven fabric.

8. An article as claimed in claim 6, wherein the pieces of fabric are secured together in stretch-resisting manner along a third line extending substantially perpendicular to said first line and disposed to the same side of said first line as said second line.

9. An article as claimed in claim 8, wherein the first line is substantially perpendicular to the second line and the pieces of fabric are secured together in stretch-resisting manner along a fourth line extending substantially perpendicular to said third line and joining said third line to said second line.

10. An article as claimed in claim 6, 7, 8 or 9, wherein the pieces of fabric are secured together in stretch-resisting manner along each of said lines by sewing along each line.

11. An article as claimed in claim 6, being a jacket made of knit fabric and having at least a partial lining of woven fabric, said piece of knit fabric being a front panel of the jacket and said piece of woven fabric being a lining therefor and being secured to said front panel along at least a shoulder seam and an armhole seam.

12. An article as claimed in claim 6, being a jacket made of knit fabric and having at least a partial lining of woven fabric, said piece of knit fabric being a back panel of the jacket and said piece of woven fabric being a lining therefor and being secured to said back panel along at least a shoulder seam and an armhole seam.

13. An article as claimed in claim 6, being a jacket made of knit fabric and having at least a partial lining of woven fabric, said piece of knit fabric being a sleeve panel of the jacket and said piece of woven fabric being a lining therefor and being secured to said sleeve panel along at least an armhole seam and an underarm seam.

14. An article as claimed in claim 6, being a skirt made of knit fabric and having at least a partial lining of woven fabric, said piece of knit fabric being a panel of the skirt and said piece of woven fabric being a lining therefor and being secured to said skirt panel along at least a waistband seam and a lengthwise seam.

15. An article as claimed in claim 6, being pants made of knit fabric and having at least a partial lining of woven fabric, said piece of knit fabric being a back panel of the pants and said piece of woven fabric being a lining therefor and being secured to said back panel along at least a waistband seam, a leg seam and a back seam.

16. An article as claimed in claim 6, being pants made of knit fabric and having at least a partial lining of woven fabric, said piece of knit fabric being a front panel of the pants and said piece of woven fabric being a lining therefor and being secured to said front panel along at least a waistband seam, a leg seam and a front seam.

* * * * *